US008337369B1

(12) United States Patent
Jacobson

(10) Patent No.: US 8,337,369 B1
(45) Date of Patent: Dec. 25, 2012

(54) ADJUSTABLE QUICK-RELEASE RATCHETING BINDING SYSTEM FOR ADJUSTABLE LEG EXTENSIONS

(76) Inventor: Zachary T. Jacobson, Menomonie, WI (US)

( * ) Notice: Subject to any disclaimer, the term of this patent is extended or adjusted under 35 U.S.C. 154(b) by 885 days.

(21) Appl. No.: 11/613,115

(22) Filed: Dec. 19, 2006

Related U.S. Application Data

(60) Provisional application No. 60/751,460, filed on Dec. 19, 2005, provisional application No. 60/858,668, filed on Nov. 13, 2006.

(51) Int. Cl.
*A63B 25/00* (2006.01)
*A63B 71/00* (2006.01)
*A61F 2/60* (2006.01)

(52) U.S. Cl. ..... 482/75; 482/76; 482/139; 482/908; 623/28

(58) Field of Classification Search ..... 482/51, 482/75–76, 79, 139, 148, 908; 623/27–29; D21/422; *A63B 25/00, 71/00; A61F 2/60*
See application file for complete search history.

(56) References Cited

U.S. PATENT DOCUMENTS

| | | | | |
|---|---|---|---|---|
| 31,210 | A | 1/1861 | Johnson | |
| 642,841 | A | 2/1900 | Freshour | |
| 2,620,345 | A | 12/1952 | Dean | |
| 2,747,300 | A * | 5/1956 | Field | 36/7.5 |
| 2,827,897 | A | 3/1958 | Pawlowski | |
| 3,058,120 | A * | 10/1962 | Smith et al. | 623/28 |
| 3,626,519 | A * | 12/1971 | Baker | 623/28 |
| 3,902,199 | A * | 9/1975 | Emmert | 623/28 |
| 4,186,920 | A * | 2/1980 | Fiore et al. | 482/79 |
| 4,255,822 | A * | 3/1981 | Dixon | 623/28 |
| 4,415,063 | A | 11/1983 | Hutchison | |
| 4,570,926 | A * | 2/1986 | Ensmenger | 482/75 |
| 4,927,137 | A * | 5/1990 | Speer | 482/76 |
| 5,016,869 | A | 5/1991 | Dick et al. | |
| 5,295,932 | A | 3/1994 | Rowan | |
| D359,313 | S | 6/1995 | Hashman | |
| 5,498,220 | A | 3/1996 | Ensmenger | |
| 5,514,054 | A | 5/1996 | Rowan | |
| 5,593,373 | A | 1/1997 | Hale | |
| 5,645,515 | A * | 7/1997 | Armstrong et al. | 482/75 |
| 6,231,485 | B1 * | 5/2001 | Dreissigacker et al. | 482/72 |
| 6,517,586 | B2 * | 2/2003 | Lin | 623/28 |
| 6,648,803 | B1 | 11/2003 | Jay | |
| 6,719,671 | B1 | 4/2004 | Bock | |

(Continued)

FOREIGN PATENT DOCUMENTS

FR 2620345 A1 9/1987

*Primary Examiner* — Loan Thanh
(74) *Attorney, Agent, or Firm* — Albert W. Watkins

(57) ABSTRACT

An adaptable mounting plate is secured to and thereby combined with a stilt boot plate. The mounting plate pivotally couples a quick-release ratcheting strap and an adjustable arched heel backer to the stilt boot plate. The mounting plate and backer keep a user's feet in correct position, thereby providing both lateral and forward stability needed during movement. The pivotal quick release ratcheting strap simultaneously drives the user's heel into the arched heel backer, ensuring a secure coupling therebetween, and draws the user's shoe or boot tightly down against the stilt boot plate. The toe strap is also preferably a quick-release ratcheting strap, and is preferably attached in existing toe strap mounting holes. Likewise, the upper calf support utilizes the same type of quick-release ratcheting strap as the ankle, and is preferably mounted with nylon lock nuts through mounting holes on the calf support.

7 Claims, 3 Drawing Sheets

U.S. PATENT DOCUMENTS

| | | | | |
|---|---|---|---|---|
| 6,840,893 | B2 | 1/2005 | Yoon | |
| 7,108,640 | B2 * | 9/2006 | Emmert | 482/75 |
| 2002/0077704 | A1 * | 6/2002 | Lin | 623/28 |
| 2002/0177906 | A1 | 11/2002 | Phillips | |
| 2003/0203793 | A1 * | 10/2003 | Emmert | 482/75 |
| 2004/0176221 | A1 | 9/2004 | Waxler | |
| 2005/0202940 | A1 * | 9/2005 | Simmons | 482/75 |
| 2005/0277522 | A1 | 12/2005 | Wong | |
| 2006/0191745 | A1 * | 8/2006 | McAllister | 182/121 |
| 2006/0211545 | A1 | 9/2006 | Smyer | |
| 2006/0217241 | A1 | 9/2006 | Novara | |
| 2007/0027004 | A1 | 2/2007 | Novara | |
| 2007/0042874 | A1 | 2/2007 | Arginsky et al. | |
| 2007/0042875 | A1 | 2/2007 | Arginsky et al. | |
| 2007/0072746 | A1 | 3/2007 | Fukui | |
| 2007/0167296 | A1 * | 7/2007 | Hika | 482/76 |
| 2007/0219070 | A1 | 9/2007 | Anderson | |
| 2007/0219643 | A1 | 9/2007 | Townsend et al. | |
| 2007/0232459 | A1 | 10/2007 | Lin | |
| 2007/0270288 | A1 | 11/2007 | Hansard | |
| 2008/0058171 | A1 * | 3/2008 | Sener et al. | 482/75 |
| 2008/0096732 | A1 * | 4/2008 | Lin et al. | 482/75 |

* cited by examiner

ADJUSTABLE QUICK-RELEASE RATCHETING BINDING SYSTEM FOR ADJUSTABLE LEG EXTENSIONS

CROSS REFERENCE TO RELATED APPLICATIONS

This application claims priority to U.S. provisional patent application 60/751,460 filed Dec. 19, 2005 and to U.S. provisional patent application 60/858,668 filed Nov. 13, 2006 each naming the present inventor and each also incorporated herein by reference in entirety.

BACKGROUND OF THE INVENTION

1. Field of the Invention

This application pertains generally to elevated walking devices involving user translation, commonly referred to as stilts, and more particularly to such devices having a specific step or shoe engaging structure. More particularly, the present invention pertains to a shoe or boot-engaging structure which securely engages a user's shoe or boot, and which is readily affixed to existing and diverse stilts, in particular to those stilts which are articulating. The present invention, in combination with articulating stilts, provides natural bio-mechanical motion that has been absent or unattainable in the prior art.

2. Description of the Related Art

The concept of stilts is a very old one, predating the United States patent system. Illustrating this is U.S. Pat. No. 31, 210 to Johnson, simply entitled "Stilt," dating back to January, 1861. This patent is clearly not the first conception of stilts, but is instead an improvement thereto. At the time of this patent, this stilt simply provided a foot rest or step onto which a user would stand, without any straps or bindings holding one's shoes thereto.

As might be expected from such an old technology, there have over the years been a wide variety of improvements, and an associated increase in applications to which the benefits of stilts have been applied. One application from earlier times is believed to have been simply that of improved transportation, through both wetlands and also above troublesome low-lying flora and fauna. Through the years, and beyond entertainment with which most people are familiar, many other diverse applications have evolved. There are many agricultural applications, including the gathering of fruits and nuts, the pruning of trees, and improved viewing of flocks. Construction applications have likewise developed, including the use of stilts with drywall finishing, painting, electrical and plumbing work, window washing, and ceiling installation and repair. There have been many other diverse applications too numerous to mention where the additional elevation afforded by stilts has or might prove to be highly desirable.

One patent which is particularly exemplary of the improvements that have been made is U.S. Pat. No. 3,902,199 to Emmert, the teachings which are incorporated by reference. The Emmert patent illustrates one particular stilt design which has met with much long term commercial success. Therein, an articulating stilt is illustrated. For the purposes of the present specification, an articulating stilt will be understood to mean a stilt which permits a variation in the angle between a line drawn between the toe and heel of the stilt and the vertical risers, and which couples this variation in angle to a boot engaging member or members, such that the wearer will have an ability to both sense and through natural movement control the variation of this aforementioned angle. Through the linkages illustrated and taught by Emmert, a wearer has the ability to pivot their foot and the stilt foot in a natural motion during forward and backward movement. It is, for example, possible to remove all weight from the heel portion, and stand entirely on the toe portion of the stilt.

In spite of the capabilities that are afforded through these stilts or leg extensions, an important issue has always been and continues to be that of safe use. As is well known, the additional height that the stilts provide is the feature that makes stilts desirable in many applications, but is also the feature that makes falls far more dangerous. Falls from only somewhat greater heights are disproportionately more hazardous. In addition, the extra length provided by the stilts in association with the coupling between person and stilts at only a few discrete places may also place unusual forces upon the leg that can lead to strains, sprains and fractures that are both different from and frequently more severe than could occur without the stilts. Finally, a wearer has no sensitivity at the extremity, which is quite unlike a living foot containing many active sensory nerves. Consequently, electrical cords, ropes, wires, uneven surfaces, and other obstacles and challenges may adversely affect the ability of a person to step properly and might then lead to a spill. In view of the direct correlation of harm with a fall where a person was wearing stilts, the chances of problems have heretofore been believed to be greater with stilts than without. As a result, the use of stilts has been effectively eliminated in the workplace in several states.

Heretofore, the industry has attempted to ameliorate the dangers associated with stilts by providing only nominal coupling between a person's foot or shoe and the stilts. Lightweight and narrow leather, cotton or poly straps with simple buckles have been used to retain the shoe with the stilt. In the event of an impending fall or spill, the person may pivot their foot relative to the support, or even in some cases remove their foot from the stilt, thereby theoretically enabling them to land foot down on the ground. This ability to pivot within relatively narrow and loose-fitting straps, or to completely remove one's foot from the stilt, has long been felt to provide the least chance for fractures and other serious injuries. Further, the relative motion that can be obtained between the foot and the higher leg support was thought to offer at least some opportunity for a decrease or amelioration of the unusual forces.

In stark contrast, the present inventor has determined that these assumptions made in the prior art were only correct for the types of bindings which were known and used in the industry, and even then were commonly only partially correct. As but one example, it is entirely impossible to predict the interaction between an unknown boot or shoe and the straps of the prior art. In some combinations, the straps may simply slide away during a fall. In other cases, the straps and shoe-wear may bind and force undesirable injury.

Further complicating the predictable operation of the prior art straps is the tendency for these prior art straps to loosen during use. Leather and cotton both tend to stretch as a result of the application of large forces, causing the straps to lengthen during use. However, when the stilts are removed and temporarily stored, the materials will return to their original pre-use size. This tendency to return to original shape means that with each and every use the straps are subject to undesirable loosening. Loosening in turn is directly associated with a loss of control over the position and operation of the stilts. Loss of control increases the chance of an accident or fall. Nevertheless, it is this same characteristic of stretching upon the application of unusually large forces that the designers have relied upon to provide safe release from the straps, or at least reduction of harm to a user, during a fall or accident. Consequently, the very feature that the prior art relies upon for safety is responsible for a loss of control and the inducement of accidents. Furthermore, to ensure the effectiveness of this "safeguard", narrow straps are preferred, since such straps will stretch most on the application of large forces. Once again though, contrary to desirable use and wear, the narrow straps provide the least amount of comfort and control for a wearer, and these narrow straps require frequent readjustment just to keep the stilts in place.

A number of other types of stilts and straps are known and represented in the prior art. These patents include U.S. Pat. Nos. 6,648,803 to Jay; 4,570,926 and 5,498,220 to Ensmenger; 5,295,932 and 5,514,054 to Rowan; D359,313 to Hashman; 6,517,586 to Lin; 4,255,822 to Dixon; 4,415,063 to Hutchinson; 5,593,373 to Hale; published application 2005/0202940 to Simmons; and French patent 2,620,345 to Champel; the teachings of each which are incorporated herein by reference.

In the present invention, through a selection of a very different type of strap in combination with a preferred type of stilt, the likelihood of injury may be reduced significantly and is believed to be lower than the likelihood of injury from not using the stilts.

This surprising result is better appreciated when the alternatives to stilts are considered. For exemplary purposes, in the construction trade the use of a ladder is extremely inefficient. A worker may only reach a few feet in each direction from the ladder without unbalancing the ladder and potentially tipping it. On uneven or irregular surfaces, the ladder may even initially be unbalanced, not standing correctly on all four feet. A worker trying to reach too far in any direction while on a ladder, including but not limited to climbing to the top of a ladder, is known to be the cause for many construction injuries. To expand reach and elevation, while still avoiding the use of stilts, other workers rely instead upon portable scaffolding. This scaffolding requires significant set-up and take-down time, and the scaffolding itself may have significant mass or weight. The disassembly and movement of such scaffolding is, in and of itself, a common cause of workplace injuries.

What is desired then is a way to best ameliorate the deficiencies of prior art stilts, such that the risks of use are less than the risks associated with alternatives, so that the use of stilts may be applied to all situations where stilts are inherently more efficient than the alternatives.

SUMMARY OF THE INVENTION

The present invention combines a paddled, ratcheting, and pivotal ankle strap with an arched heel cup and a removable mounting bracket, the combination which is most preferably attached in place of the prior art weak heel cup. The mounting bracket is flat on the bottom, and includes side walls that extend perpendicularly from to the base. In one embodiment, an adjustable heel backer arch is provided which pivots with respect to the side walls, as does the side-wall attached quick-release ratcheting ankle strap. While not forming a critical part of the present invention, toe and calf straps are also preferably provided using similar quick-release ratcheting straps attached by screws, most preferably directly into the original mounting holes.

In a first manifestation, the invention is, in combination, an articulating stilt and a heel binding. The articulating stilt has a foot operative to contact a surface to be traversed, a boot rest operative to support a human foot thereon, and at least two risers extending between the foot and boot rest. The articulating stilt additionally has a toe strap operative to restrain a human forefoot relative to the boot rest. The toe strap is coupled to the boot rest, while remaining repositionable relative to the heel binding to match changes in orientation within the stilt foot to changes in orientation between toe strap and heel binding. An upper leg binding and an extension coupling the boot rest to upper leg binding also are provided by the articulating stilt. The heel binding comprises a coupler engaging heel binding to boot rest, side walls which define lateral limits to movement of a human foot upon the boot rest, a heel cup which defines a rear limit to movement of a human foot the boot rest, and a ratcheting ankle strap which tightens to draw a human foot against the boot rest and heel cup.

In a second manifestation, the invention is a replacement heel binding in combination with an articulating stilt. The heel binding comprises a coupler engaging heel binding to boot rest, side walls which define lateral limits to movement of a human foot upon the boot rest, a heel cup which defines a rear limit to movement of a human foot upon the boot rest, and a ratcheting ankle strap which tightens to draw a human foot against the boot rest and heel cup.

In a third manifestation, the invention is a method of retrofitting an existing articulating stilt and then using the same. According to the method, a first heel binding is released from a boot rest. Subsequent to the releasing step, a second heel binding is coupled to the boot rest. The second heel binding has a base, a pair of side walls extending from the base, a heel backer and a pivoting ratcheting ankle strap. A position of the adjustable heel backer is set relative to the base and side walls to accommodate a particular boot size and geometry. First and second segments of the pivoting ratcheting ankle strap are opened, and a foot covering is inserted adjacent to the boot rest. First and second segments of the pivoting ratcheting ankle strap are pivoted to generally encompass the foot covering. First and second segments of the pivoting ratcheting ankle strap are coupled about the foot covering, and then tightened to a tension generally defining a snug fit about the foot covering. The first and second segments of the pivoting ratcheting ankle strap are ratcheted to a tension greater than the snug fit tension, thereby securing the foot covering to boot rest and heel backer.

OBJECTS OF THE INVENTION

Exemplary embodiments of the present invention solve inadequacies of the prior art by providing, in combination, an articulating stilt and an articulating, adjustable, quick-release ratcheting heel-binding system.

A first object of the invention is to provide a relatively safer stilt than has heretofore been available. A second object of the invention is to increase the sensitivity, control, and stability that a user has when using stilts designed in accord with the present invention. An ancillary object is the provision of a stilt which affords correct bio-mechanical movement. Another object of the present invention is to both facilitate and also reduce the time required for entry into and release from this safer and better controlled stilt. Yet another object of the present invention is an improvement in the comfort of stilts, accompanied by a reduced amount of fatigue, such that the stilts may be worn for long periods of time to meet the requirements of certain applications. A further object of the invention is to permit the millions of existing stilts that remain functional, and all too commonly under-utilized, to be readily retrofit and thereby gain the benefits of the present invention. Yet another object of the present invention is to provide the foregoing objectives in a product which may be readily installed by a user without the need for special training or knowledge.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides a relatively safer stilt than has heretofore been available. This is achieved through a relatively simple retrofit method which enables the millions of existing stilts that remain functional, and all too commonly under-utilized, to gain the benefits of the present invention.

As already described herein above, the safety of the present stilts is quite surprising when considered in light of the teachings of the art which are to provide more elastic and force sensitive straps. The present invention, in stark contrast thereto, provides snug and secure coupling to the stilts. However, in accord with the teachings of the present invention, this secure coupling ensures that the user has increased sensitivity, control, and stability has when using stilts designed in accord with the present invention.

Figure 1:
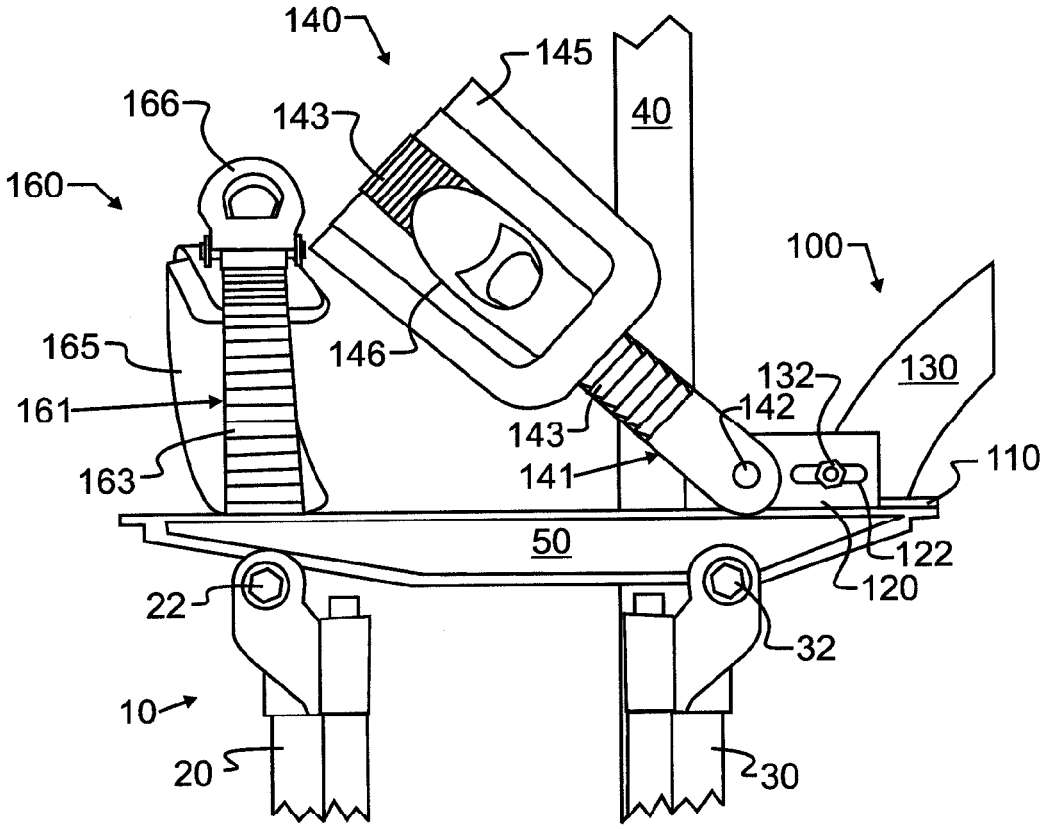
FIG. 1 illustrates a preferred embodiment adjustable quick-release ratcheting binding system combination with adjustable leg extensions from an enlarged partial cut-away view side elevational view.
Figure 2:
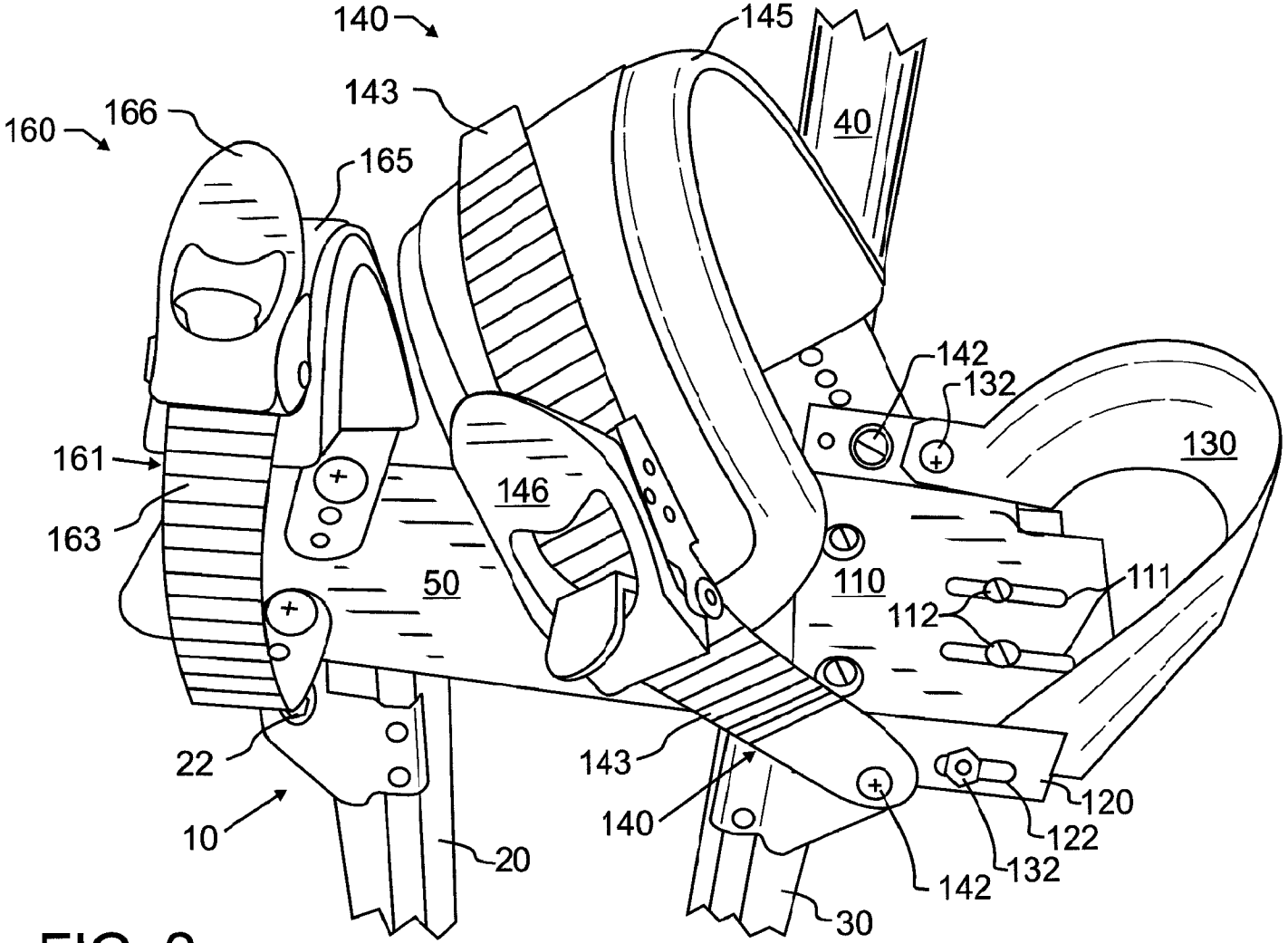
FIG. 2 illustrates the preferred embodiment adjustable quick-release ratcheting binding system in combination with adjustable leg extensions of FIG. 1 from a projected view.
Figure 3:
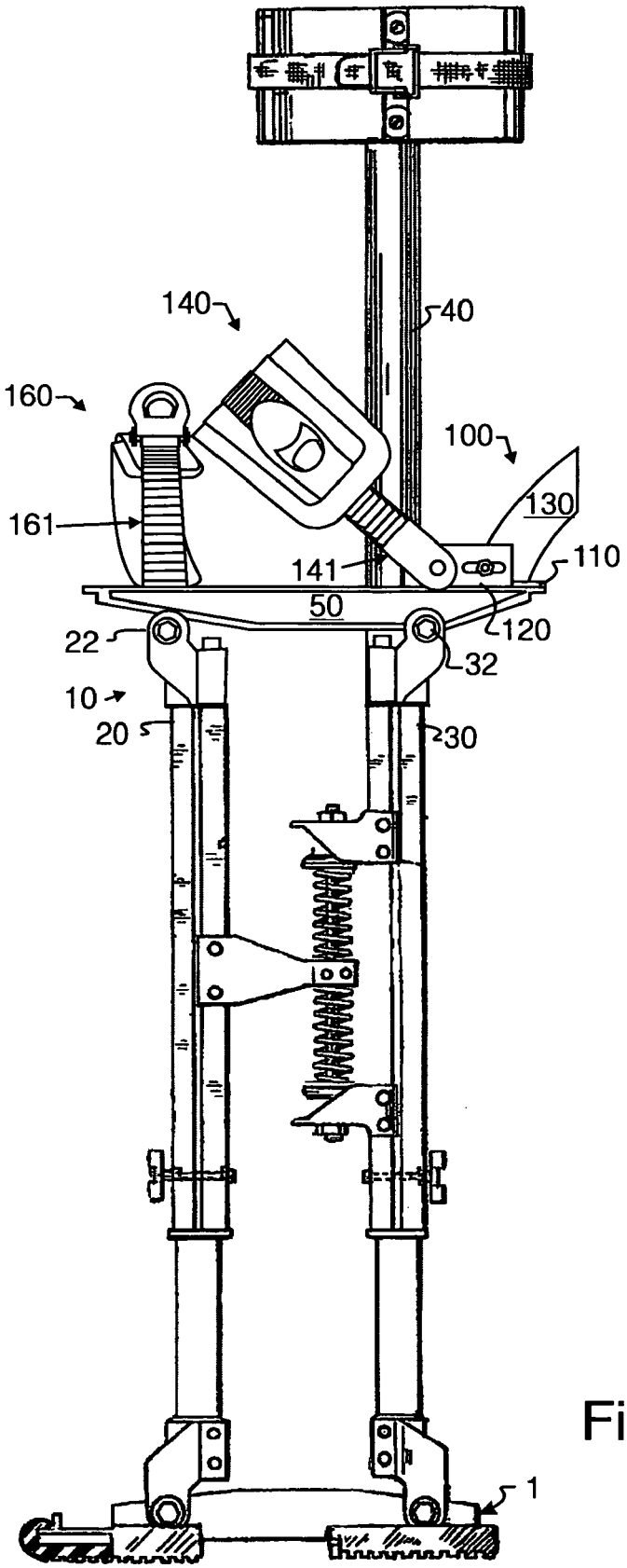
FIG. 3 illustrates the preferred embodiment adjustable quick-release ratcheting binding system of FIG. 1 from the same side elevation view, showing the entire stilt.

A preferred embodiment combination articulating stilt 10 and heel binding 100 is illustrated in FIGS. 1-2. The articulating stilt 10 is most preferably of the type illustrated by Emmert and incorporated herein above by reference, as illustrated in FIG. 3. As is known from the Emmert patent, this stilt has a foot 1 operative to contact a surface to be traversed, which would ordinarily be the ground, a floor or other surface. A boot rest 50 is designed to support a human foot, boot, foot covering or the like thereon. At least two risers 20, 30 extend between the foot 1 and boot rest 50. The length of these risers determines the elevation provided by the stilts. In typical construction applications this may only be one or a few feet, though in other applications very different riser lengths may be appropriate.

Articulating stilt 10 additionally has a toe strap operative to restrain a human forefoot relative to boot rest 50. In the prior art, this toe strap was simply a cotton strap with a simple buckle. However, in accord with the teachings of the present invention, a much more secure quick-release ratcheting strap 160 is coupled to boot rest 50. For the purposes of the present specification, a quick-release ratcheting strap system will be defined herein to be a strap which couples to hold two straps together at tensions greater than may be readily attained through tension manually applied directly to a segment of a strap passing through a buckle. This additional tension in the most preferred embodiment is achieved through the pivoting of a lever such as levers 146, 166 which ratchet to draw one binding strap segment, 141, 161 respectively, past the lever in a one-way direction. Through lever action, levers 146, 166 are designed to act against a saw-tooth pattern 143, 163 respectively, in the surface of the strap. The lever thereby provides a mechanism for producing these greater tensions. These ratcheting straps, as but one example have been sold in the trade by Technine Incorporated of Williston Vt. under the model name "Comfort King".

In the preferred embodiment illustrated in the figures, toe strap 160 will remain repositionable relative to quick-release ratcheting strap 140 to match changes in orientation within the stilt foot to changes in orientation between toe strap 160 and quick-release ratcheting strap 140. This is achieved first through a pair of pivots 22, 32 which couple boot rest 50 to risers 20, 30. These pivots, as with others described herein, may be produced in a variety of ways, but will most commonly be fabricated using post, shoulder or like bolts, or other suitable fasteners as is known in the hardware art. However, when significant rotation occurs between boot rest 50 and risers 20, 30, quick-release ratcheting strap 140 will also most preferably rotate relative to side walls 120. An absence of rotation therebetween will lead to undesirable constriction of motion, particularly with the preferred snugly tensioned ratcheting straps, and will reduce the efficacy of the present system. Consequently, in the preferred embodiment, quick-release ratcheting strap 140 is likewise coupled to side walls 120 through a pair of post, shoulder or like bolts, or other suitable fasteners.

An upper leg strap and an extension coupling boot rest 50 to the upper leg strap are also provided by the articulating stilt as shown by Emmert. While not critical to the operation of the present invention, it is preferable to again replace the simple calf strap of Emmert with a quick-release ratcheting strap similar to straps 140, 160, though sized for a human calf. In addition, such a strap would most preferably also include sufficient padding to adequately distribute forces across a larger surface area than in the prior art without constricting circulation within the leg. An added benefit to the use of quick-release ratcheting straps as illustrated herein arises from the facility and speed by which the preferred embodiment may be attached and detached. With only a few quick movements, the user may step into and tighten the preferred embodiment, and with even fewer and simpler quick movements, the user may disengage and release the preferred embodiment.

With padding appropriate to the particular strap, these preferred quick-release ratcheting straps will also vastly improve the comfort of the stilts, accompanied by a reduced amount of fatigue, such that the stilts may be worn for long periods of time to meet the requirements of certain applications. This not only improves work efficiency, but it is also known that fatigue is a common cause of many mishaps. It follows then that reducing the amount of fatigue, so long as a worker still stops at or near the same time, will also reduce the likelihood for mishaps or injuries.

Heel binding 100 comprises a coupler engaging heel binding 100 to boot rest 50. In the preferred embodiment, the particular coupling may be varied to correspond with the couplings that exist with a particular model or brand of stilts. With the Emmert stilts used with the preferred embodiment, the particular coupling is through a pair of screw or bolt-type fasteners 112 visible in FIG. 2 which pass through base 110 into boot rest 50. Slots 111 are most preferably formed in base 110, which permits base 110 to be adjusted towards and away from toe strap 160, to thereby accommodate varying boot sizes. Side walls 120 rise from the generally planar surface of base 110, and thereby define lateral limits to movement of a human foot, shoe or boot upon boot rest 50. In the preferred embodiment, these side walls 120 rise perpendicular to base 110, though there is no requirement of the same. Side walls 120 may be formed unitarily with base 110, or through any other suitable method.

Coupled to side walls 120 is an arched heel cup 130 which defines a rear limit to movement of a human foot, shoe or boot upon boot rest 50 and base 110. As is visible in FIG. 1, this arched heel cup 130 rises above base 110 substantially, which permits the lower heel portion of a foot covering or foot to be captured between arched heel cup 130 and base 110. The geometry of arched heel cup 130 may be customized, where desired to conform to one or more particular types of foot coverings, to best engage therewith. For exemplary purposes only, and not limited thereto, some boots have a pronounced Achilles tendon region which is recessed relative to the sole adjacent to the heel. In such instance, arched heel cup 130 may be shaped to define an arch which matches the geometry of the particular shoe, or of shoes or boots of more broad types or geometries. As may be apparent, the angle of quick-release ratcheting strap 140 leads, when quick-release ratcheting strap 140 is tightened, to the drawing of a human foot or foot covering against the boot rest and heel cup securement therewith.

The present invention, as manifested by the present preferred embodiment, provides a stilt which affords correct bio-mechanical movement. This is because the user may extend the stilt in front of their leg, as with a normal walking motion. In the prior art, using the known heel cups and straps, the wearer's heel would be prone to slipping or total release from the heel cup. This would, in turn, lead to a spill and possible injury, since the stilt would fail to stay properly aligned and coupled to the person's leg. In contrast, in the present invention such motions are desirable. With the preferred articulating stilt of Emmert, s as modified by and in combination with the present invention, even the articulation within the ankle joint is preserved. Consequently, bio-mechanical movements which mimic ordinary movements are preserved.

As may now be apparent, the present invention is preferably implemented as a method of retrofitting an existing articulating stilt and then using the same. The method includes a number of steps, the first of which is to release a pre-existing heel strap from the stilt boot rest 50. Subsequent to the releasing step, the preferred embodiment heel binding 100 is coupled to boot rest 50. A position of the adjustable heel backer, or arched heel cup 130, is set relative to base 110 and side walls 120 to accommodate a particular boot size and geometry. First segment 141 and second segment 145 of quick-release ratcheting strap 140 are opened, and a foot covering such as a boot or shoe, or even a foot, is inserted adjacent to boot rest 50. The segments 141, 145 of quick-release ratcheting strap 140 are pivoted to generally encompass the foot covering and are then coupled about the foot covering. Next, they are tightened to a tension generally defining a snug fit about the foot covering. Finally, they are ratcheted to a tension greater than the snug fit tension, thereby securing the foot covering to boot rest 50 and arched heel cup 130.

The preferred embodiment has been described with respect to both structural features and methods of use. From the foregoing descriptions, it should now be apparent that the materials used for the production of the present invention and embodiments thereof is not critical, so long as the materials do not interfere with the functions and operations that have been outlined herein above. As but one example, arched heel cup 130, base 110 and side walls 120 in the preferred embodiment are fabricated from metals suitable for the intended work environment. However, a number of plastics and composites are known which would provide suitable performance. Consequently, one of ordinary skill in the art, with the knowledge of the present disclosure, will choose materials suitable for a given application in consideration of an intended ultimate cost of fabrication.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, an articulating stilt and a heel binding, said articulating stilt comprising:

a stilt foot operative to contact a surface to be traversed;

a boot rest operative to support a human foot covering thereon;

at least two risers extending between said stilt foot and said boot rest;

a toe strap operative to restrain a human forefoot relative to said boot rest and coupled to said boot rest while remaining repositionable relative to said heel binding to match changes in orientation within said stilt foot;

an upper leg binding; and an extension coupling said boot rest to said upper leg binding;

said heel binding comprising:

side walls and a base rigidly affixed to and extending between said side walls, said side walls which operatively define lateral limits to movement of a human foot covering upon said boot rest and said base having at least one open slot formed therein extending longitudinally generally parallel to a longitudinal direction of said boot rest;

a removable fastener passing through said at least one slot in said base, said fastener when fastened rigidly engaging said heel binding base to said boot rest and when released permitting spatial adjustment between said heel binding and said boot rest by enabling said at least one slot to be moved relative to said fastener, to thereby permit said heel binding base to be adjusted horizontally towards and away from said toe strap to accommodate varying boot sizes;

a rigid heel cup rigidly attached to said heel binding base which operatively defines a rear limit to movement of a human foot covering upon said boot rest and which further operatively captures said human foot covering between said rigid heel cup and said heel binding base, wherein a position of said heel cup is horizontally adjustable by way of at least one longitudinal slot in at least one of said sidewalls extending in said longitudinal direction; and a ratcheting ankle strap which operatively tightens to draw a human foot covering against said boot rest and against said heel cup and retain coupling there between throughout a normal walking motion.

2. The combination articulating stilt and heel binding of claim 1, wherein said heel cup further comprises an arch shape connected at distal ends to said boot rest and between said distal ends rising above and separate from said boot rest to define an opening therebetween suitable to receive a heel therein and cooperative with said ratcheting ankle strap to trap said heel therein.

3. The combination articulating stilt and heel binding of claim 1, wherein said at least two risers are generally parallel and form a quadrilateral linkage with said boot rest and said stilt foot.

4. The combination articulating stilt and heel binding of claim 1, wherein said risers further provide a space between said stilt foot and said boot rest.

5. The combination articulating stilt and heel binding of claim 1, wherein said removable fastener further comprises a bolt anchored in said boot rest and passing through said base slot.

6. A heel binding in combination with an articulating stilt boot rest, comprising:

a coupler rigidly affixing said heel binding to said boot rest;

side walls which operatively define lateral limits to movement of a human foot covering upon said boot rest;

a heel cup which operatively securely captures a human foot covering between said heel cup and said boot rest, said heel cup having a fixed geometry arch shape connected at distal ends to said boot rest and between said distal ends rising above and separate from said boot rest to define an opening therebetween suitable to receive a human foot covering heel therein and cooperative with said ratcheting ankle strap to trap said human foot covering heel therein, wherein a position of said heel cup is horizontally adjustable by way of at least one longitudinal slot in at least one of said sidewalls extending in a longitudinal direction of said boot rest; and a ratcheting ankle strap which operatively tightens to draw said human foot covering against said boot rest and against said heel cup and retain coupling there between throughout a normal walking motion;

a base rigidly affixed to and extending between said side walls and having at least one slot therein extending longitudinally generally parallel to said longitudinal direction;

said coupler further comprising a removable fastener passing through said at least one slot in said base, said fastener when fastened engaging said heel binding to said boot rest and when released permitting spatial adjustment between said heel binding and said boot rest by enabling said at least one slot to be moved relative to said fastener to thereby permit said base to be horizontally adjusted towards and away from a toe strap to accommodate varying boot sizes.

7. The heel binding in combination with an articulating stilt of claim 6, wherein said heel cup comprises metal.

* * * * *